US009159257B2

(12) United States Patent
Kim et al.

(10) Patent No.: US 9,159,257 B2
(45) Date of Patent: Oct. 13, 2015

(54) ORGANIC LIGHT EMITTING DISPLAY AND METHOD OF DRIVING THE SAME

(75) Inventors: Keum-Nam Kim, Yongin (KR); Sang-Moo Choi, Yongin (KR); Bo-Yong Chung, Yongin (KR); Hui Nam, Yongin (KR)

(73) Assignee: SAMSUNG DISPLAY CO., LTD., Yongin, Gyeonggi-Do (KR)

( * ) Notice: Subject to any disclaimer, the term of this patent is extended or adjusted under 35 U.S.C. 154(b) by 465 days.

(21) Appl. No.: 13/200,399

(22) Filed: Sep. 23, 2011

(65) Prior Publication Data

US 2012/0105390 A1 May 3, 2012

(30) Foreign Application Priority Data

Oct. 28, 2010 (KR) ..... 10-2010-0105798

(51) Int. Cl.

| | |
|---|---|
| ***G09G 5/00*** | (2006.01) |
| ***G09G 3/00*** | (2006.01) |
| ***G09G 3/32*** | (2006.01) |

(52) U.S. Cl.

CPC ..... *G09G 3/003* (2013.01); *G09G 3/3225* (2013.01); *G09G 2300/0842* (2013.01); *G09G 2300/0861* (2013.01); *G09G 2320/0209* (2013.01)

(58) Field of Classification Search

CPC ..... G09G 5/00; G09G 3/32; G09G 3/30
USPC ..... 345/83, 76, 204, 77
See application file for complete search history.

(56) References Cited

U.S. PATENT DOCUMENTS

| | | | | |
|---|---|---|---|---|
| 5,995,070 | A * | 11/1999 | Kitada | 345/83 |
| 7,911,425 | B2 * | 3/2011 | Goden et al. | 345/76 |
| 2007/0279343 | A1 * | 12/2007 | Kim | 345/77 |
| 2008/0030435 | A1 * | 2/2008 | Kim | 345/76 |
| 2010/0033461 | A1 | 2/2010 | Hasegawa et al. | |
| 2010/0091207 | A1 | 4/2010 | Hasegawa et al. | |
| 2010/0194866 | A1 | 8/2010 | Komiya | |
| 2011/0032342 | A1 | 2/2011 | Kato et al. | |
| 2011/0157158 | A1 | 6/2011 | Hasegawa et al. | |

FOREIGN PATENT DOCUMENTS

| | | | |
|---|---|---|---|
| CN | 101477782 | A | 7/2009 |
| CN | 101800029 | A | 8/2010 |
| JP | 2010-39398 | A | 2/2010 |
| JP | 2010-54662 | A | 3/2010 |
| JP | 2010-93740 | A | 4/2010 |

(Continued)

OTHER PUBLICATIONS

Chinese Office Action dated Dec. 1, 2014.
Japenese Office Action dated Nov. 18, 2014.

*Primary Examiner* — Quan-Zhen Wang
*Assistant Examiner* — Yuk Chow
(74) *Attorney, Agent, or Firm* — Lee & Morse, P.C.

(57) ABSTRACT

The organic light emitting display includes a plurality of pixels positioned at intersections of scan lines, emission control lines, and data lines, a scan driver for sequentially supplying scan signals to the scan lines at a first driving frequency in order to select the pixels in units of horizontal lines, and an emission driver for sequentially supplying emission control signals to the emission control lines at a second driving frequency different from the first driving frequency in order to control emission of the pixels.

24 Claims, 5 Drawing Sheets

(56) References Cited

FOREIGN PATENT DOCUMENTS

| | | | |
|---|---|---|---|
| JP | 2011-133652 | A | 7/2011 |
| KR | 10-0306695 | B1 | 8/2001 |
| KR | 10 2005-0005646 | A | 1/2005 |
| KR | 10 2008-0066504 | A | 7/2008 |
| KR | 10 2009-0123896 | A | 12/2009 |
| WO | WO 2010/082479 | A1 | 7/2010 |

* cited by examiner

ORGANIC LIGHT EMITTING DISPLAY AND METHOD OF DRIVING THE SAME

BACKGROUND

1. Field

Embodiments relate to an organic light emitting display and a method of driving the same. More particularly, the embodiments relate to an organic light emitting display capable of being driven at a low driving frequency, and a method of driving the same.

2. Description of the Related Art

High weight and large volume are disadvantages of cathode ray tubes (CRT). Recently, various flat panel displays (FPD) have been developed that are capable of reducing weight and volume. The FPDs include liquid crystal displays (LCD), field emission displays (FED), plasma display panels (PDP), and organic light emitting displays.

Among the FPDs, the organic light emitting displays display images using organic light emitting diodes (OLED). The OLEDs generate light by re-combination of electrons and holes. The organic light emitting display has high response speed and is driven with low power consumption.

The organic light emitting display includes a plurality of data lines, scan lines, and a plurality of pixels. The plurality of pixels are at intersections of power lines, arranged in a matrix. Each pixel includes an organic light emitting diode, at least two transistors, and at least one capacitor. The two transistors include a drive transistor.

SUMMARY

Embodiments are directed to an organic light emitting display and a method of driving the same.

An embodiment provides an organic light emitting display, including a plurality of pixels positioned at intersections of scan lines, emission control lines, and data lines, a scan driver for sequentially supplying scan signals to the scan lines at a first driving frequency, in order to select the pixels in units of horizontal lines, and an emission driver for sequentially supplying emission control signals to the emission control lines at a second driving frequency, different from the first driving frequency, in order to control emission of the pixels.

The second driving frequency may be higher than the first driving frequency. The first driving frequency may be set to 120 Hz. The second driving frequency may be set to be at least 240 Hz. The scan driver may supply the scan signals to the scan lines for one horizontal period.

The emission driver may supply an emission control signal to a jth emission control line to overlap a scan signal supplied to a jth (j is a natural number) scan line. The emission driver may supply an emission control signal to a (j+1)th emission control line after a first period, the first period shorter than the first horizontal period after the emission control signal is supplied to the jth emission control line. The emission driver may supply the emission control signals so that the emission time of the pixels of an ith (i is a natural number) frame does not overlap the emission time of the pixels of an (i+1)th frame. The data driver may supply left data signals to the data lines in synchronization with scan signals supplied to the scan lines in the ith (i is a natural number), and the data driver may supply right data signals to the data lines in synchronization with scan signals supplied to the scan lines in the (i+1)th frame. The width of the emission control signals may be set to be equal to or smaller than ½.

Each of the plurality of pixels may include an organic light emitting diode (OLED), a pixel circuit for charging a voltage corresponding to a data signal when a scan signal is supplied to a scan line, the pixel circuit controls an amount of current supplied to the OLED to correspond to the charged voltage, and a control transistor coupled between the OLED and the pixel circuit, the control transistor turned off when an emission control signal is supplied to an emission control line, and the control transistor turned on in the other cases.

Another embodiment provides a method of driving an organic light emitting display including a plurality of pixels positioned at intersections of scan lines, emission control lines, and data lines, including supplying sequential scan signals to the scan lines in order to select the pixels and supplying sequential emission control signals to the emission control lines at a second driving frequency, different from the first driving frequency, in order to control emission of the pixels.

In the organic light emitting display according to the present embodiment and the method of driving the same, the scan signals and the data signals may be synchronized with the scan signals, and may be supplied to the low driving frequency (for example, 120 Hz).

BRIEF DESCRIPTION OF THE DRAWINGS

The accompanying drawings, together with the specification, illustrate exemplary embodiments, and, together with the description, serve to explain the principles of the exemplary embodiments.

DETAILED DESCRIPTION

Korean Patent Application No. 10-2010-0105798, filed on Oct. 28, 2010, in the Korean Intellectual Property Office, and entitled: "Organic Light Emitting Display Device and Driving Method Thereof" is incorporated by reference herein in its entirety.

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey the scope of the inventive concept to those skilled in the art.

Figure 1:
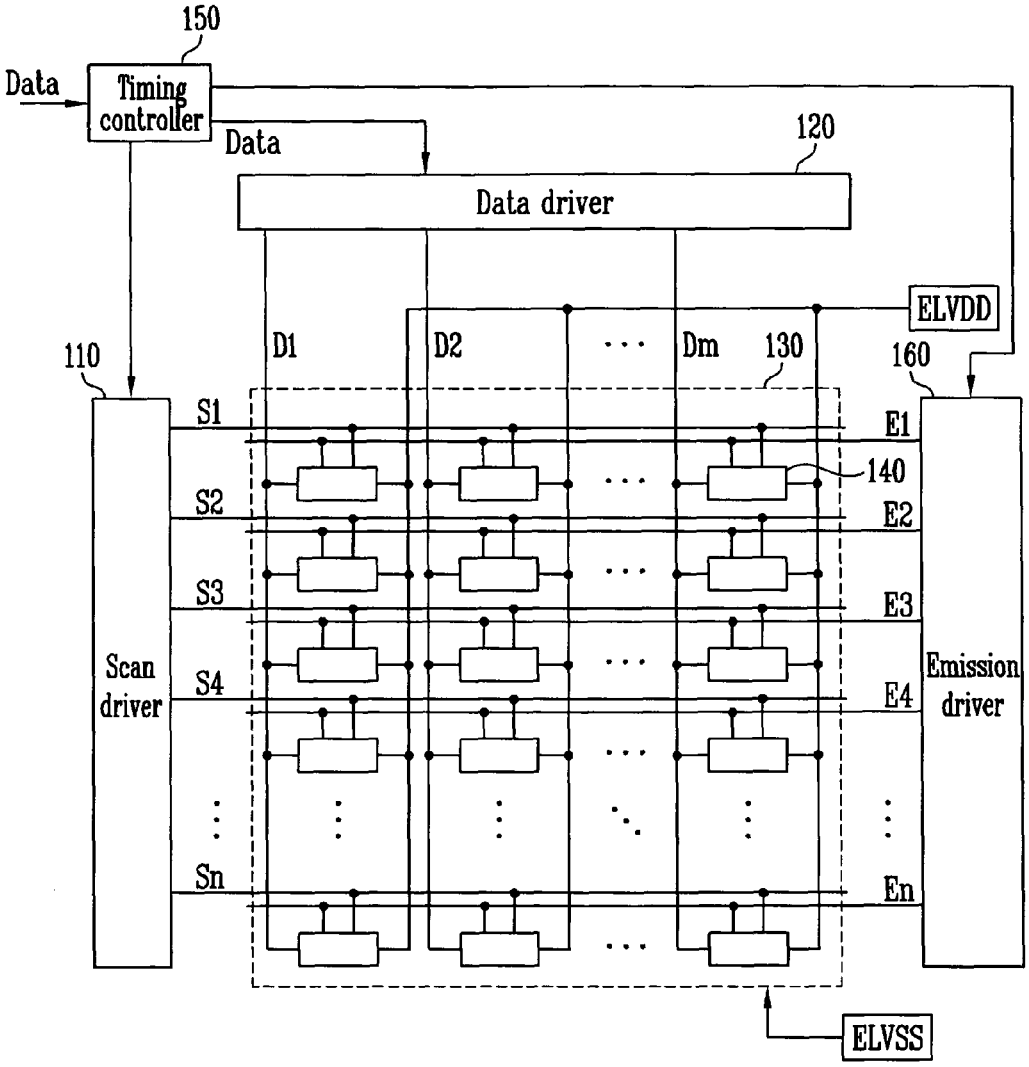
FIG. 1 illustrates an organic light emitting display according to an embodiment.
Figure 2:
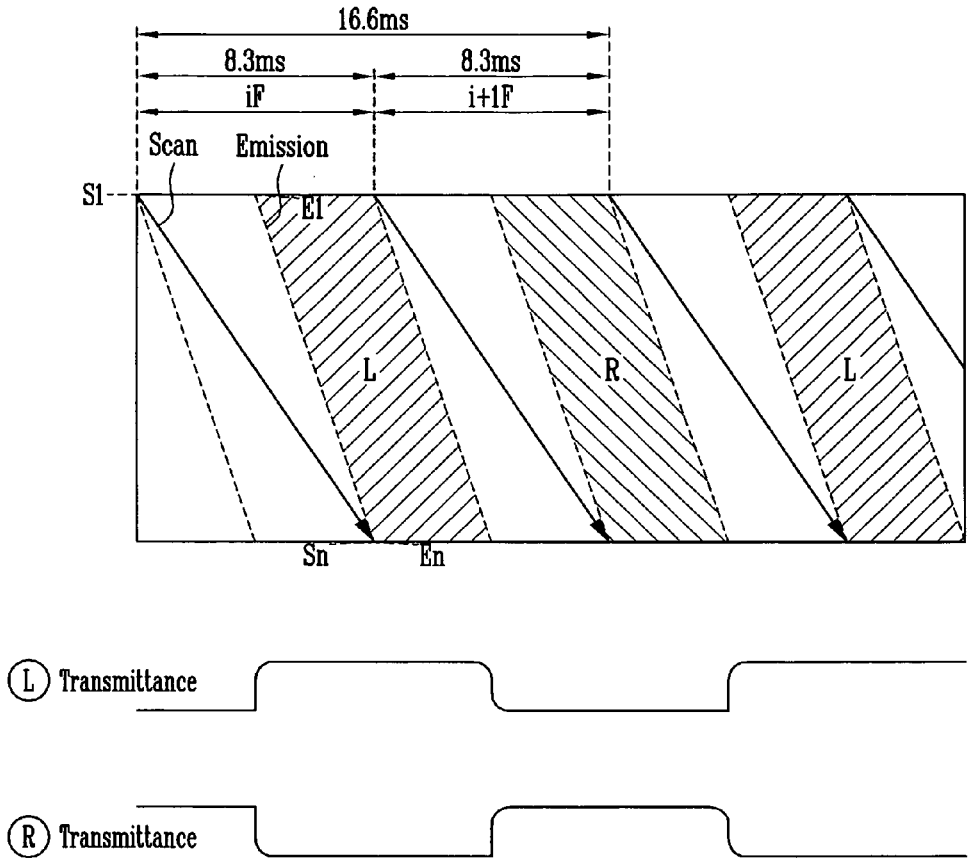
FIG. 2 illustrates the frames of an organic light emitting display according to the embodiment.

FIG. 1 illustrates an organic light emitting display according to an embodiment. FIG. 2 illustrates the frame of an organic light emitting display according to the embodiment.

Referring to FIGS. 1-2, the organic light emitting display, according to the embodiment, includes a pixel unit 130, emission control lines E1 to En, data lines D1 to Dm, a scan driver 110 for driving the scan lines S1 to Sn, a data driver 120 for driving the data lines D1 to Dm, an emission driver 160 for driving the emission control lines E1 to En, and a timing controller 150. The timing controller 150 controls the scan driver 110, the emission driver 160, and the data driver 120. The pixel unit 130 includes pixels 140 positioned at the intersections of scan lines S1 to Sn.

The scan driver 110 sequentially supplies scan signals every frame to the scan lines S1 to Sn. According to the present embodiments, since two frames iF and i+1F are included in the period of 16.6 ms, the scan driver 110 supplies the scan signals at a driving frequency of 120 Hz.

The data driver 120 supplies data signals to the data lines D1 to Dm in synchronization with the scan signals supplied to the scan lines S1 to Sn. The data driver 120 supplies left data signals to correspond to the scan signals supplied to the scan lines S1 to Sn in the ith (i is a natural number) frame iF. The data driver 120 also supplies right data signals to correspond to the scan signals supplied to the scan lines S1 to Sn in the (i+1)th frame i+1F. Since the data driver 120 supplies the data signals to the data lines D1 to Dm in synchronization with the scan signals, the organic light emitting display is driven at the driving frequency of 120 Hz.

The emission driver 160 sequentially supplies emission control signals to the emission control lines E1 to En. The emission driver 160 controls the supply of the emission control signals so that the pixels 140 emit light in the partial periods of the frames.

The emission driver 160 supplies an emission control signal to a jth emission control line Ej to overlap the scan signal supplied to a jth (j is a natural number) scan line Sj. Then, the emission driver 160 supplies an emission control signal to a (j+1)th emission control line Ej+1 after a first period. The first period after the emission control signal is supplied to the jth emission control line Ej. The first period is set to be shorter than one horizontal period 1H to which the scan signals are supplied. Then, the emission driver 160 supplies the emission control signals to the emission control lines E1 to En so that times for which the pixels 140 are emitted may not overlap respective frames. Thus, in the ith frame iF and the (i+1)th frame i+1F, the emission times of the pixels 140 do not overlap.

As illustrated in FIG. 2, an emission control line Emission, i.e. the supply of the emission control signals is set to have a steeper slope than a scan supply line Scan, i.e. the supply of the scan signals. Thus, in the respective frames, the emission times of the pixels 140 do not overlap so that a 3D image may be realized without crosstalk.

The timing controller 150 controls the scan driver 110, the data driver 120, and the emission driver 160.

When the organic light emitting display is to display three-dimensional images, a viewer views the display through shutter glasses. The shutter glasses receive light from a left lens in the ith frame iF and receives light from a right lens in the (i+1)th frame i+1F. The viewer viewing the shutter glasses recognizes the three-dimensional image supplied through the shutter glasses.

Figure 3:
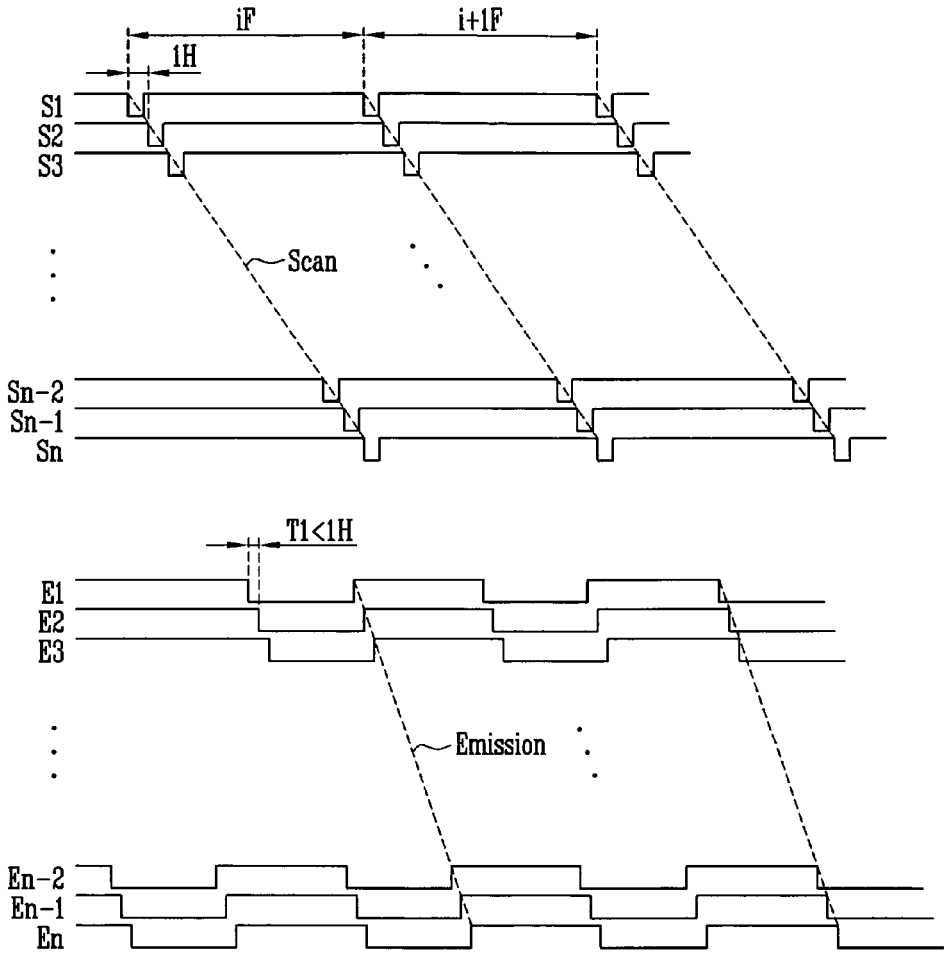
FIG. 3 illustrates driving waveforms supplied from the scan driver and the emission driver of FIG. 1.

FIG. 3 illustrates driving waveforms supplied from the scan driver and the emission driver of FIG. 1.

Referring to FIG. 3, the scan driver 110 sequentially supplies the scan signals to the scan lines S1 to Sn in the frames iF and i+1F. The scan driver 110 supplies the scan signals at a first driving frequency, e.g. a frequency of 120 Hz.

The emission driver 160 sequentially supplies the emission control signals to the emission control lines E1 to En in the frames iF and i+1F. The emission driver 160 supplies the emission control signals at a second driving frequency. The second driving frequency is higher than the first driving frequency. The second driving frequency may be, for example, at least 240 Hz.

When the emission control signals are supplied at the second driving frequency, a first period T1, between the emission control signals, is set to be shorter than the one horizontal period 1H. When the emission control signals are supplied at the second driving frequency, the emission time of the pixels 140 may be maximally secured. The emission signals, supplied to the emission control lines E1 to En, are set to have the same width. The emission signals are also set so the emission time of the frames do not overlap.

When the width of the emission control signals is set to be less than ½ frame, the emission time of the pixels 140 is set to be more than ½ frame. In this scenario, the emission times of the pixels 140 of the frames overlap. Thus, crosstalk may be generated when an image is realized. According to the present embodiments, the width of the emission control signals is set so that the emission control signals may be supplied in a period no more than the ½ frame.

Since the emission control signals are driven at a higher driving frequency than the scan signals, the emission start time and the data writing point of time of each line may be determined as follows:

First line: Emission start time−Data writing point of time=½ frame

Second line: Emission start time−Data writing point of time=½ frame−T1

Third line: Emission start time−Data writing point of time=½ frame−2*T1

Last line: Emission start time−Data writing point of time=0

The emission start times are the point of time when the emission control signals are supplied. When the emission control signals are supplied, the pixels emit light. The data writing point of time is the point of time when the scan signals are supplied.

Figure 4:
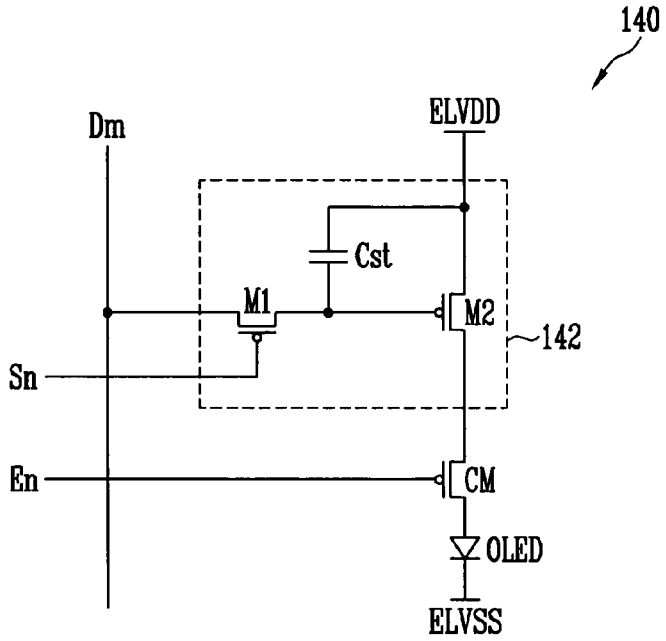
FIG. 4 illustrates an embodiment of the pixel of FIG. 1.

FIG. 4 illustrates an embodiment of the pixel of FIG. 1.

Referring to FIG. 4, a pixel 140, according to the embodiment, includes an organic light emitting diode (OLED), a pixel circuit 142 for controlling the amount of current supplied to the OLED, and a control transistor CM coupled between the pixel circuit 142 and the OLED.

The anode electrode of the OLED is coupled to the control transistor CM. The cathode electrode of the OLED is coupled to a second power source ELVSS. The OLED generates light with predetermined brightness to correspond to the amount of current supplied from the pixel circuit 142.

The pixel circuit 142 controls the amount of current supplied to the OLED. The pixel circuit 142 may be formed of various types of circuits. For example, the pixel circuit 142 may include a first transistor M1, a second transistor M2, and a storage capacitor Cst.

The first electrode of the first transistor M1 is coupled to the data line Dm. The second electrode of the first transistor M1 is coupled to the gate electrode of the second transistor M2. The gate electrode of the first transistor M1 is coupled to the scan line Sn. The first transistor M1 is turned on when a scan signal is supplied to the scan line Sn. The scan signal is supplied to the scan line Sn to electrically couple the data line Dm to the gate electrode of the second transistor M2.

The first electrode of the second transistor M2 is coupled to a first power source ELVDD. The second electrode of the second transistor M2 is coupled to the first electrode of the control transistor CM. The gate electrode of the second transistor M2 is coupled to the second electrode of the first transistor M1. The second transistor M2 supplies the current to the OLED corresponding to the voltage coupled to the gate electrode of the second transistor M2.

The storage capacitor Cst is coupled between the gate electrode of the second transistor M2 and the first power source ELVDD. The storage capacitor Cst charges the voltage corresponding to the data signal.

The first electrode of the control transistor CM is coupled to the pixel circuit 142 and the second electrode of the control transistor CM is coupled to the anode electrode of the OLED. The gate electrode of the control transistor CM is coupled to the emission control line En. The control transistor CM is turned off when an emission control signal is supplied to the emission control line En. The control transistor CM is turned on when the emission control signal is not supplied.

Figure 5:
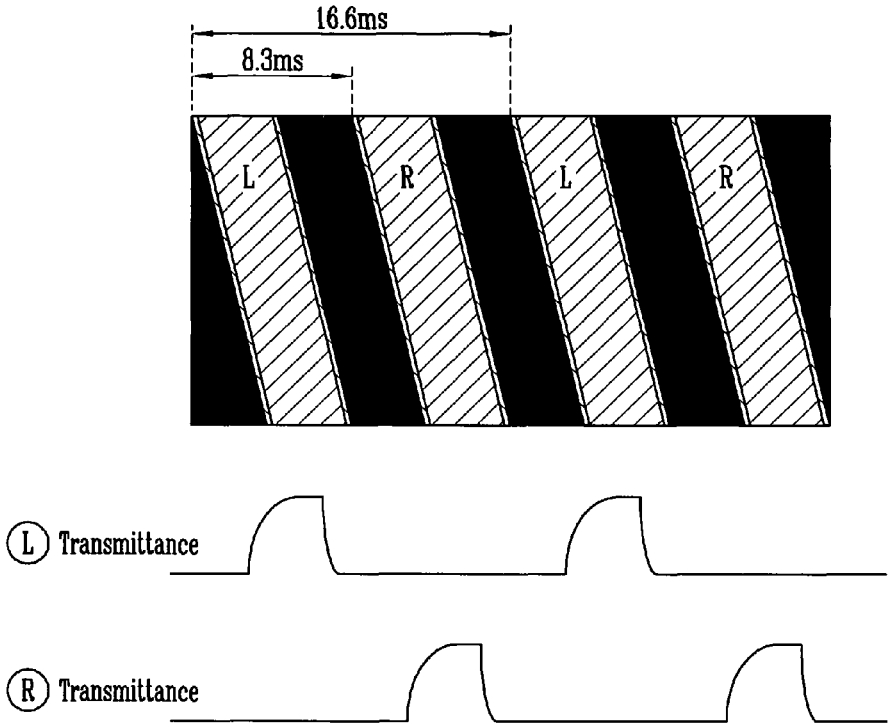
FIG. 5 illustrates the frames of a conventional organic light emitting display.

As illustrated in FIG. 5, the organic light emitting display of a conventional organic light emitting display includes four frames in a period of 16.6 ms in order to realize a 3D image. Among the four frames, a first frame displays a left image. A third frame displays a right image. A second frame and a fourth frame display a black image. The black image displayed in the second frame and the fourth frame prevents a left image and a right image from being mixed with each other. If the left image and a right image are not mixed, crosstalk is prevented.

However, in order to have the four frames included in the period of 16.6 ms in the conventional organic light emitting display, the organic light emitting display must be driven at a 240 Hz driving frequency. When the organic light emitting display is driven at a high frequency, power consumption increases, stability deteriorates, and manufacturing cost increases.

In the present embodiments, by supplying scan signals at a different frequency than the emission control signals, an organic light emitting display and a method of driving the same, is capable of being driven at a low driving frequency.

Exemplary embodiment has been disclosed herein, and although specific terms are employed, they are used and are to be interpreted in a generic and descriptive sense only and not for purpose of limitation. Accordingly, it will be understood by those of ordinary skill in the art that various changes in form and details may be made without departing from the spirit and scope of the inventive concept as set forth in the following claims.

What is claimed is:

1. An organic light emitting display, comprising:

a plurality of pixels positioned at intersections of scan lines, emission control lines, and data lines, the plurality of pixels arranged in at least three of rows and a plurality of columns;

a scan driver to sequentially supply scan signals to the scan lines at a first driving frequency to select the pixels in units of horizontal lines; and an emission driver to sequentially supply emission control signals to the emission control lines at a second driving frequency to control emission of the pixels, wherein the scan signals and the emission control signals are sequentially supplied by a frame, and a slope of supply of the scan signals is substantially different from a slope of supply of the emission control signals, wherein the slope of supply of the scan signals is inversely proportional to an interval between adjacent scan signals, and the slope of supply the emission control signals is inversely proportional to an interval between adjacent emission control signals, wherein after an j-th scan signal of the scan signals is supplied to pixels in an j-th row, an j-th emission control signal of the emission control signals is supplied to the pixels in the j-th row with an j-th interval between the j-th scan signal and the j-th emission control signal, and wherein the j-th interval decreases by a constant time, as j increases by 1 (j is a natural number).

2. The organic light emitting display as claimed in claim 1, wherein the second driving frequency is higher than the first driving frequency.

3. The organic light emitting display as claimed in claim 2, wherein the first driving frequency is 120 Hz.

4. The organic light emitting display as claimed in claim 2, wherein the second driving frequency is at least 240 Hz.

5. The organic light emitting display as claimed in claim 1, wherein the scan driver is to supply the scan signals to the scan lines for one horizontal period.

6. The organic light emitting display as claimed in claim 5, wherein the emission driver is to supply an emission control signal to a j-th emission control line to overlap a scan signal supplied to a scan line.

7. The organic light emitting display as claimed in claim 6, wherein the emission driver is to supply an emission control signal to a (j+1)-th emission control line subsequent to the emission control signal being supplied to the j-th emission control line, and after a first period, the first period being shorter than a first horizontal period corresponding to the interval between adjacent scan signals.

8. The organic light emitting display as claimed in claim 1, wherein the emission driver is to supply the emission control signals not to overlap emission time of the pixels of an i-th (i is a natural number) frame and emission time of the pixels of an (i+1)-th frame each other.

9. The organic light emitting display as claimed in claim 1, further comprising a data driver to:

supply left data signals to the data lines in synchronization with scan signals supplied to the scan lines in an i-th frame (i is a natural number), and supply right data signals to the data lines in synchronization with scan signals supplied to the scan lines in an (i+1)-th frame.

10. The organic light emitting display as claimed in claim 1, wherein a width of each of the emission control signals is equal to or lesser than a half (½) of a frame.

11. The organic light emitting display as claimed in claim 1, wherein each of the plurality of pixels comprises:

an organic light emitting diode (OLED);

a pixel circuit to charge a voltage corresponding to a data signal when a scan signal is supplied to a scan line, the pixel circuit to control an amount of current supplied to the OLED to correspond to the charged voltage; and a control transistor coupled between the OLED and the pixel circuit, wherein the control transistor is turned off when an emission control signal is supplied to an emission control line, and the control transistor is turned on in the other cases.

12. The organic light emitting display as claimed in claim 1, wherein the slopes of the supply of the emission control signals have steeper slopes than slopes of the supply of the scan signals.

13. The organic light emitting display as claimed in claim 1, each of the plurality of pixels includes a first transistor, a second transistor, and a storage capacitor, wherein a first electrode of the first transistor is coupled to a data line, a second electrode of the first transistor is coupled to a gate electrode of the second transistor, and a gate electrode of the first transistor is coupled to a scan line.

14. The organic light emitting display as claimed in claim 13, wherein the gate electrode of the second transistor is coupled to the second electrode of the first transistor.

15. The organic light emitting display as claimed in claim 1, wherein the constant time is the interval between the adjacent emission control signals.

16. A method of driving an organic light emitting display including a plurality of pixels positioned at intersections of scan lines, emission control lines, and data lines, the plurality of pixels arranged in at least three of rows and a plurality of columns, the method comprising:

sequentially supplying scan signals to the scan lines at a first driving frequency to select the pixels; and sequentially supplying emission control signals to the emission control lines at a second driving frequency, different from the first driving frequency, to control emission of the pixels, wherein the scan signals and the emission control signals are sequentially supplied by a frame, and a slopes of supply of the scan signals is re substantially different from a slopes of supply of the emission control signals, wherein the slopes of supply of the scan signals are inversely proportional to an interval between adjacent scan signals, and the slopes of supply the emission control signals is inversely proportional to an interval between adjacent emission control signals, wherein after an j-th scan signal of the scan signals is supplied to pixels in an j-th row, an j-th emission control signal of the emission control signals is supplied to the pixels in the j-th row with an j-th interval between the j-th scan signal and the j-th emission control signal, and wherein the j-th interval decreases by a constant time, as j increases by 1 (j is a natural number).

17. The method as claimed in claim 16, wherein the second driving frequency is higher than the first driving frequency.

18. The method as claimed in claim 17, wherein the first driving frequency is 120 Hz.

19. The method as claimed in claim 17, wherein the second driving frequency is at least 240 Hz.

20. The method as claimed in claim 16, wherein an emission control signal is supplied to a j-th emission control line to overlap a scan signal supplied to a j-th scan line.

21. The method as claimed in claim 20, wherein an emission control signal is supplied to a (j+1)-th emission control line subsequent to the emission control signal being supplied to the j-th emission control line, and after a period shorter than one horizontal period, the one horizontal period being a width of a scan signal.

22. The method as claimed in claim 16, wherein each width of the emission control signals is set not to overlap emission time of the pixels of an i-th (i is a natural number) frame and emission time of the pixels of an (i+1)-th frame.

23. The method as claimed in claim 16, further comprising:

supplying left data signals to the data lines in synchronization with the scan signals supplied to the scan lines in an i-th frame (i is a natural number); and supplying right data signals to the data lines in synchronization with the scan signals supplied to the scan lines in an (i+1)-th frame.

24. The method as claimed in claim 16, wherein the width between each of the emission control signals is equal to or lesser than a half (½) of a frame.

* * * * *